US008276241B2

(12) United States Patent
Wu et al.

(10) Patent No.: US 8,276,241 B2
(45) Date of Patent: Oct. 2, 2012

(54) HINGE

(75) Inventors: Yi Tai Wu, Jiangsu (CN); Hsin Hung Lin, Jiangsu (CN); Shu Hua Lin, Jiangsu (CN); Shu Jiuan Lin, Jiangsu (CN)

(73) Assignee: Kunshan Huhua Metal Products Co., Ltd., Suzhou, Jiangsu (CN)

( * ) Notice: Subject to any disclaimer, the term of this patent is extended or adjusted under 35 U.S.C. 154(b) by 88 days.

(21) Appl. No.: 13/007,709

(22) Filed: Jan. 17, 2011

(65) Prior Publication Data

US 2012/0167342 A1 Jul. 5, 2012

(30) Foreign Application Priority Data

Dec. 30, 2010 (CN) ..... 2010 1 0614456

(51) Int. Cl.
*E05D 7/04* (2006.01)

(52) U.S. Cl. ..... 16/238; 16/235; 16/382; 16/242; 16/245; 16/249

(58) Field of Classification Search ..... 16/235, 16/236, 238, 242, 245, 246, 249, 382
See application file for complete search history.

(56) References Cited

U.S. PATENT DOCUMENTS 5,193,308 A * 3/1993 Davidian ..... 49/381
5,493,759 A * 2/1996 Salice ..... 16/238
5,621,947 A * 4/1997 Fitz et al. ..... 16/249
5,694,665 A * 12/1997 Strickland et al. ..... 16/238
5,799,370 A * 9/1998 Davidian et al. ..... 16/236
5,819,371 A * 10/1998 Rock et al. ..... 16/258
6,148,479 A * 11/2000 Lin ..... 16/258
6,470,531 B2 10/2002 Domenig et al.
6,516,494 B2 * 2/2003 Nakamoto et al. ..... 16/271
6,643,895 B1 11/2003 Domenig et al.
6,647,591 B1 11/2003 Domenig et al.
6,694,567 B1 * 2/2004 Domenig et al. ..... 16/238
6,779,233 B2 8/2004 Migli
6,845,544 B2 1/2005 Hofer
6,880,205 B2 4/2005 Rupprechter
6,996,877 B2 * 2/2006 Booker et al. ..... 16/257
7,017,231 B2 * 3/2006 Isele ..... 16/242

(Continued)

FOREIGN PATENT DOCUMENTS

CN 101302909 A * 11/2008

(Continued)

*Primary Examiner* — Victor Batson
*Assistant Examiner* — Emily Morgan
(74) *Attorney, Agent, or Firm* — Alan Kamrath; Kamrath IP Lawfirm, PA

(57) ABSTRACT

A hinge includes a base, a crank, a bottom board, a crank engagement seat, and a fixed seat. The crank is pivotably connected to the base. The bottom board includes at least one retaining portion, a first rivet hole and a vertical elongated hole. The crank engagement seat is connected to the crank and located between the fixed seat and the bottom board. The crank engagement seat includes first and second through-holes and a second rivet hole. The fixed seat includes first and second adjusting holes. A first adjusting member is extended through the first adjusting hole and the first through-hole into the first rivet hole. A second adjusting member is extended through the second adjusting hole into the second rivet hole. The bottom board and the crank engagement seat can be slightly moved in the vertical direction. The crank engagement seat can be slightly moved in the horizontal direction.

6 Claims, 9 Drawing Sheets

U.S. PATENT DOCUMENTS

| | | | | |
|---|---|---|---|---|
| 7,117,561 | B1 * | 10/2006 | Domenig et al. | 16/236 |
| 7,213,300 | B1 * | 5/2007 | Domenig et al. | 16/236 |
| 7,231,691 | B1 * | 6/2007 | Domenig et al. | 16/236 |
| 7,516,516 | B2 * | 4/2009 | Wu | 16/242 |
| 2006/0143859 | A1 * | 7/2006 | Wu | 16/242 |
| 2007/0143959 | A1 * | 6/2007 | Chung | 16/236 |
| 2008/0022491 | A1 * | 1/2008 | Campbell et al. | 16/236 |
| 2008/0104798 | A1 * | 5/2008 | Hoppe et al. | 16/236 |
| 2008/0104799 | A1 * | 5/2008 | Hoppe et al. | 16/238 |
| 2008/0148516 | A1 * | 6/2008 | Heid | 16/235 |
| 2008/0271291 | A1 * | 11/2008 | Chen et al. | 16/238 |
| 2008/0271292 | A1 * | 11/2008 | Lowe et al. | 16/238 |

FOREIGN PATENT DOCUMENTS

| | | | |
|---|---|---|---|
| DE | 4307067 | A1 * | 9/1994 |
| JP | 09100670 | A * | 4/1997 |

* cited by examiner

HINGE

BACKGROUND OF THE INVENTION

1. Field of the Invention

The present invention relates to a hinge and, more particularly, to a hinge that is used on furniture and that can be adjusted in multiple directions.

2. Description of the Related Art

Hinges for furniture, such as cabinets or the like, generally include a base, an extension arm, and a fixed seat. The base is pivotally connected to the extension arm and is fixed to a door. The extension arm is connected to the fixed seat that is fixed on a cabinet. An elastic element is mounted in the base and imparts force to the extension arm, providing a closing force when the door is moved inwards to close the cabinet.

Hinges for cabinets of this type can further include adjusting functions along X, Y, and Z axes after assembly, examples of which are disclosed in U.S. Pat. Nos. 6,470,531 B2; 6,643,895 B1; 6,647,591 B1; 6,694,567 B1; 6,779,233 B2; 6,845,544 B2; and 6,880,205 B2.

Adjustment in multiple directions of the above adjustable hinges is relative to the fixed seat fixed on the cabinet by an adjusting screw. However, the adjusting screw is liable to become loose after a period of time.

SUMMARY OF THE INVENTION

An objective of the present invention is to provide a hinge allowing adjustment in multiple directions, wherein the structure for adjustment provides a tightening effect to avoid loosening.

According to an aspect of the present invention, a hinge includes a base having a compartment. A crank includes opposite first and second ends. The first end of the crank is pivotably connected to the base. An elastic element is mounted in the compartment of the base and imparts elastic force to pivot the base relative to the crank to a position and to retain the base in the position. A bottom board includes a body and at least one retaining portion located on the body. The body of the bottom board includes a first rivet hole and a vertical elongated hole. A crank engagement seat includes a first engaging board and a second engaging board extended and bent from the first engaging board. The first engaging board is mounted on the bottom board, and is interlocked with the retaining portion of the bottom board to allow the first engaging board to only move relatively to the bottom board in a horizontal direction. The first engaging board includes a first through-hole aligned with the first rivet hole of the bottom board, a second rivet hole, and a second through-hole located between the first through-hole and the second rivet hole. The second through-hole is aligned with the vertical elongated hole of the bottom board. The first through-hole is a horizontal elongated hole. The second engaging board is connected to the second end of the crank. A fixed seat includes a first adjusting hole aligned with the first through-hole of the crank engagement seat, a second adjusting hole aligned with the second rivet hole of the crank engagement seat, and a locking hole located between the first and second adjusting holes. The locking hole is aligned with the second through-hole of the crank engagement seat. The first adjusting hole is a horizontal elongated hole. The second adjusting hole is a vertical elongated hole. Two spaced legs extend from a side of the fixing seat and are located on two sides of the second engaging board of the crank engagement seat. A peripheral wall extends from remaining sides of the fixed seat, defining a space for receiving the bottom board and the crank engagement seat. An adjusting assembly includes first and second adjusting members. The first adjusting member includes a first rivet portion and a first cam. The first cam of the first adjusting member is extended through the first adjusting hole of the fixed seat. The first rivet portion is extended through the first through-hole of the crank engagement seat and engaged in the first rivet hole of the bottom board. The second adjusting member includes a second rivet portion and a second cam. The second cam of the second adjusting member is extended through the second adjusting hole of the fixed seat. The second rivet portion is engaged in the second rivet hole of the crank engagement seat.

Preferably, the body of the bottom board includes a plurality of ribs.

Preferably, the at least one retaining portion of the bottom board extends in the horizontal direction by a predetermined length on the body.

Preferably, the first engaging board includes at least one connection portion corresponding to the at least one retaining portion of the bottom board, with the at least one connection portion and the at least one retaining portion being at least one pair of complementary protrusion and groove for mutual engagement.

Preferably, the at least one retaining portion extends from one face to the other face of the body of the bottom board, enabling the first engaging board to be received in a space formed by the at least one retaining portion.

Preferably, the fixed seat includes a tail extending from another side opposite to the side having the two legs. A spacing between the tail and two legs is substantially equal to a thickness of a cabinet body.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions conforming to specific force, weight, strength, and similar requirements will likewise be within the skill of the art after the following teachings of the present invention have been read and understood.

DETAILED DESCRIPTION OF THE INVENTION

Figure 1:
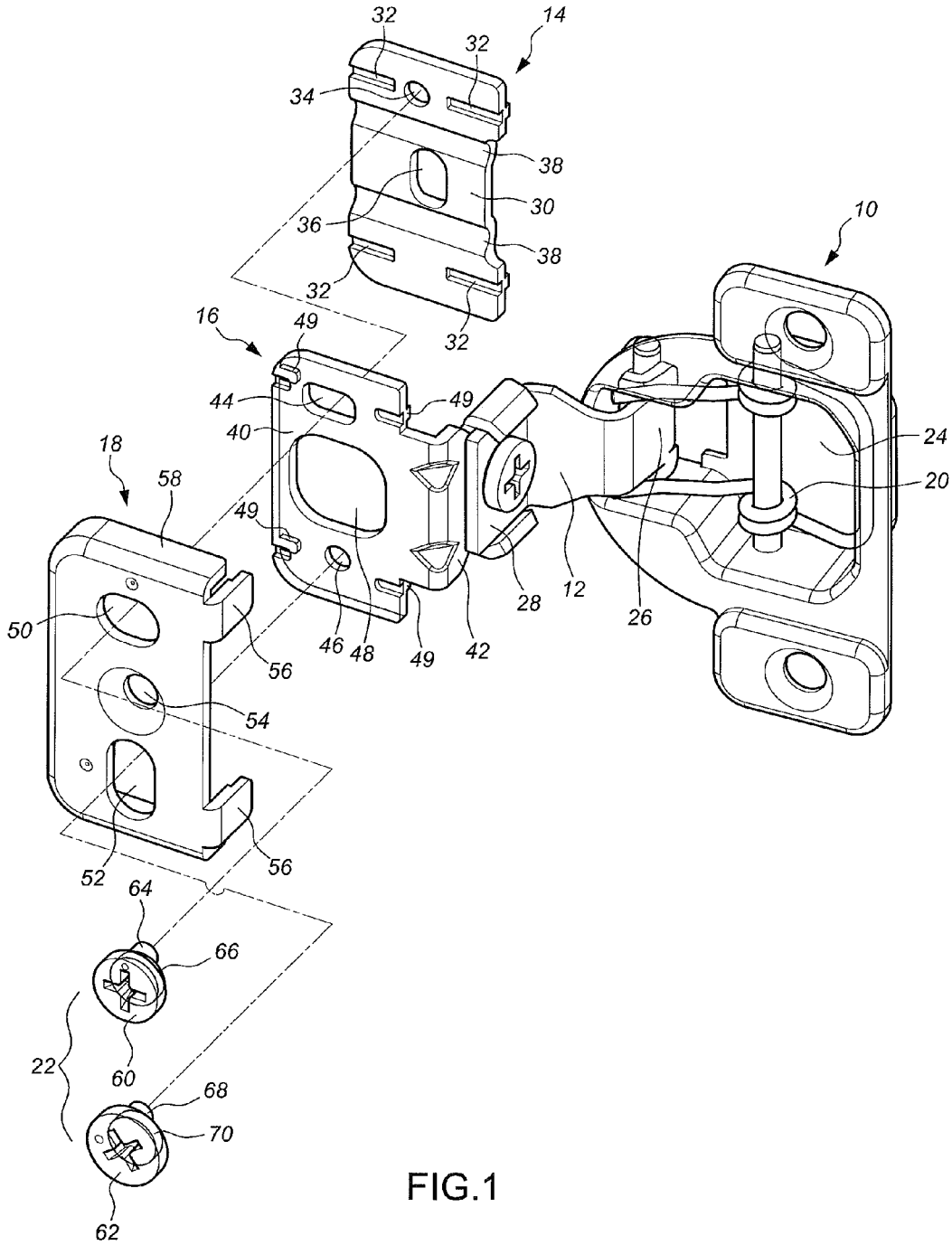
FIG. 1 shows an exploded, perspective view of a hinge of an embodiment according to the present invention.
Figure 2:
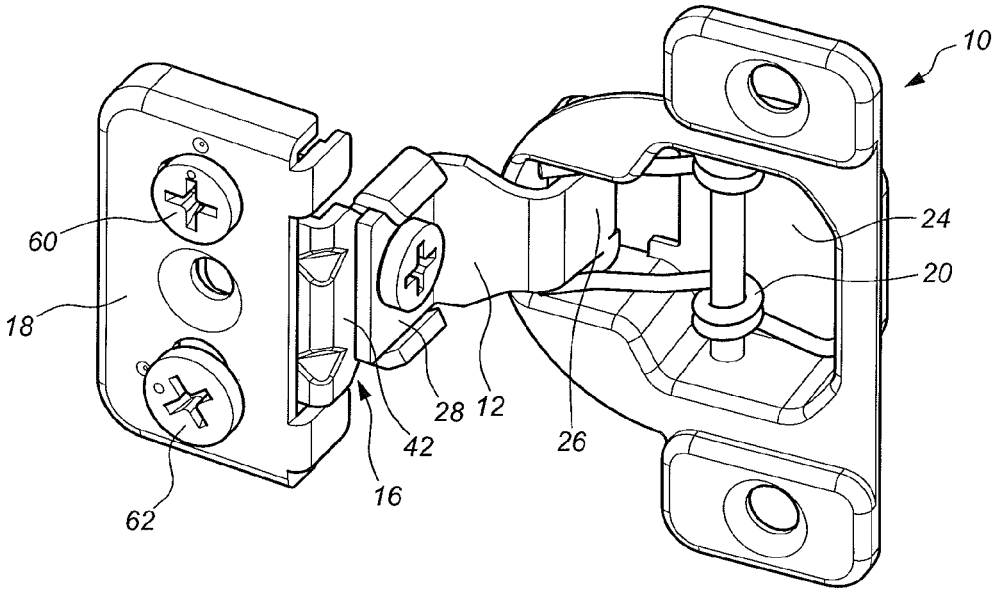
FIG. 2 shows a perspective view of the hinge of FIG. 1.
Figure 3:
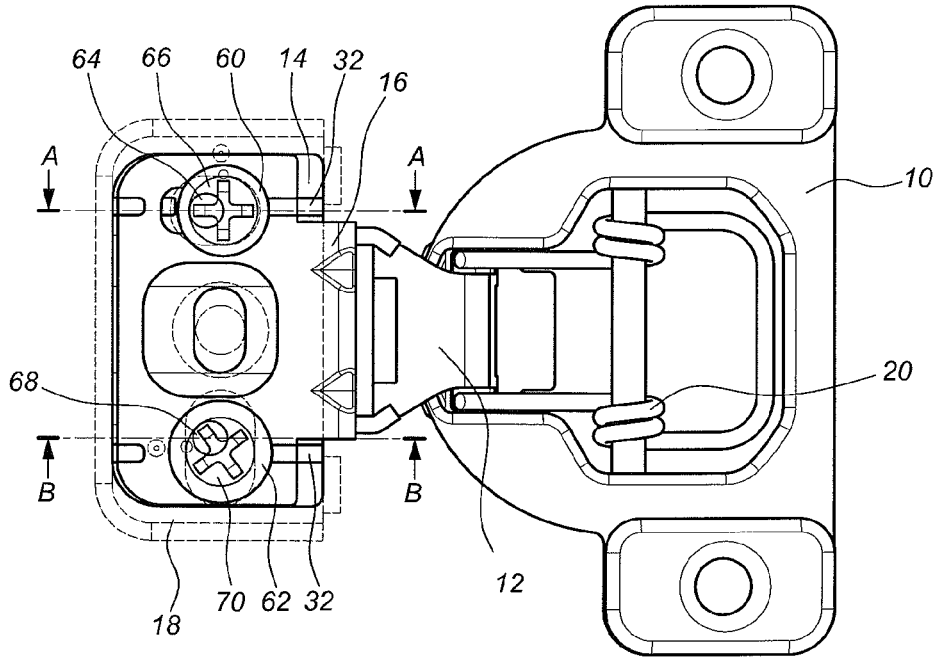
FIG. 3 shows a plan view of the hinge of FIG. 1.

FIGS. 1-3 show a preferred embodiment of a hinge according to the present invention. The hinge includes a base 10, a crank 12 pivotably connected to the base 10, a bottom board 14, a crank engagement seat 16 connected between the crank 12 and the bottom board 14, a fixed seat 18 mounted to the crank engagement seat 16, an elastic element 20 mounted to the base 10 and imparting elastic force to the crank 12 to pivot the base 10 relative to the crank 12 to a position (such as an open position or a closed position) and to retain the base 10 in the position, and an adjusting assembly 22 for minor adjustment in a relative position between the crank 12 and the base 10.

The base 10 includes a compartment 24 in which the elastic element 20 is mounted.

The crank 12 includes opposite first and second ends 26 and 28. The first end 26 is pivotably connected to the base 10. The second end 28 is connected to the crank engagement seat 16.

The bottom board 14 includes a body 30 and at least one retaining portion 32 located on the body 30. The body 30 includes a first rivet hole 34 and a vertical elongated hole 36. The at least one retaining portion 32 includes a plurality of retaining portions 32, each being located in a different position of the body 30 and extending in a horizontal direction by a predetermined length. Preferably, the body 30 includes a plurality of ribs 38. In use, the ribs 38 provide tight engagement with a piece of furniture.

Figure 4:
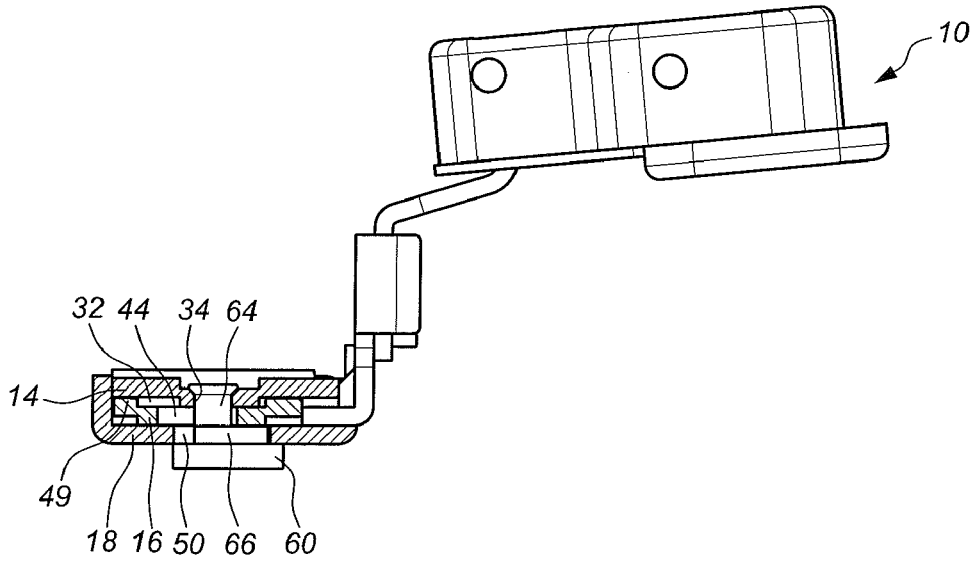
FIG. 4 shows a cross sectional view taken along section line A-A of FIG. 3.

The crank engagement seat 16 includes a first engaging board 40 and a second engaging board 42 extended and bent from the first engaging board 40. The first engaging board 40 is mounted on the bottom board 14, and is interlocked with the retaining portions 32 of the bottom board 14 to allow the first engaging board 40 to only move relatively to the bottom board 14 in the horizontal direction. The first engaging board 40 includes a first through-hole 44 aligned with the first rivet hole 34 of the bottom board 14, a second rivet hole 46, and a second through-hole 48 located between the first through-hole 44 and the second rivet hole 46. The second through-hole 48 is aligned with the vertical elongated hole 36 of the bottom board 14. The first through-hole 44 is a horizontal elongated hole. The second engaging board 42 is connected to the second end 28 of the crank 12. Furthermore, the first engaging board 40 includes at least one connection portion 49 corresponding to the at least one retaining portion 32 of the bottom board 14. By such an arrangement, the at least one connection portion 49 is engaged with the at least one retaining portion 32 of the bottom board 14. Preferably, when the at least one retaining portion 32 includes a plurality of retaining portions 32, the at least one connection portion 49 also includes a plurality of connection portions 49 corresponding to the plurality of retaining portions 32. In a preferred embodiment as shown in FIG. 4, the connection portions 49 and retaining portions 32 are structurally complementary to each other. For example, the connection portions 49 can be implemented as protrusions and the retaining portions 32 can be implemented as grooves complementary to the protrusions, or vice versa. However, structures of the connection portions 49 and retaining portions 32 are not limited to protrusions and grooves.

The fixed seat 18 includes a first adjusting hole 50 aligned with the first through-hole 44 of the crank engagement seat 16, a second adjusting hole 52 aligned with the second rivet hole 46 of the crank engagement seat 16, and a locking hole 54 located between the first and second adjusting holes 50 and 52. The locking hole 54 is aligned with the second through-hole 48 of the crank engagement seat 16. Preferably, two spaced legs 56 extend from a side of the fixing seat 18 and are located on two sides of the second engaging board 42 of the crank engagement seat 16. A peripheral wall 58 extends from the other sides of the fixed seat 18, defining a space for receiving the bottom board 14 and the crank engagement seat 16. The first adjusting hole 50 is a horizontal elongated hole, and the second adjusting hole 52 is a vertical elongated hole.

Figure 5:
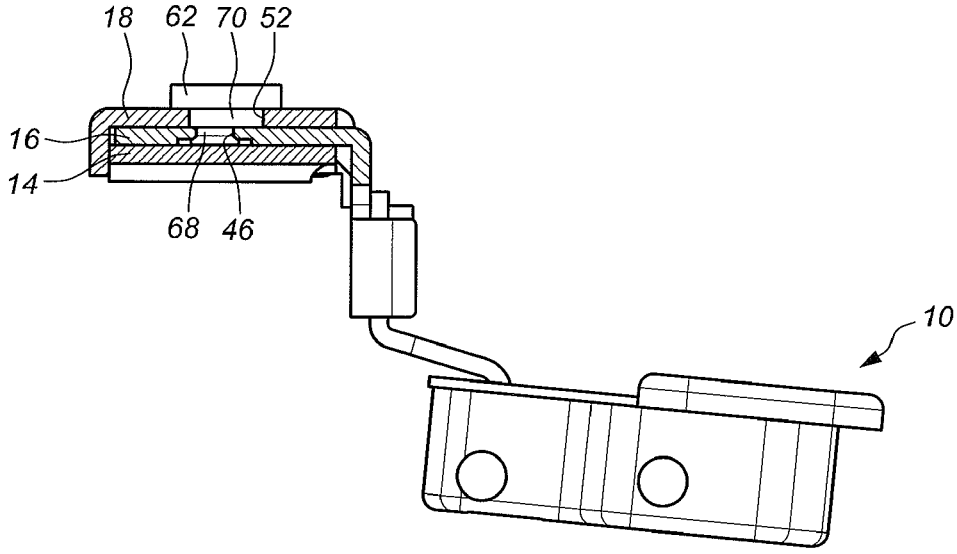
FIG. 5 shows a cross sectional view taken along section line B-B of FIG. 3.

The adjusting assembly 22 includes first and second adjusting members 60 and 62. The first adjusting member 60 includes a first rivet portion 64 and a first cam 66. The second adjusting member 62 includes a second rivet portion 68 and a second cam 70. With reference to FIG. 4, the first cam 66 of the first adjusting member 60 is extended through the first adjusting hole 50 of the fixed seat 18. The first rivet portion 64 is extended through the first through-hole 44 of the crank engagement seat 16 and engaged in the first rivet hole 34 of the bottom board 14. With reference to FIG. 5, the second cam 70 of the second adjusting member 62 is extended through the second adjusting hole 52 of the fixed seat 18. The second rivet portion 68 is engaged in the second rivet hole 46 of the crank engagement seat 16.

Figure 6:
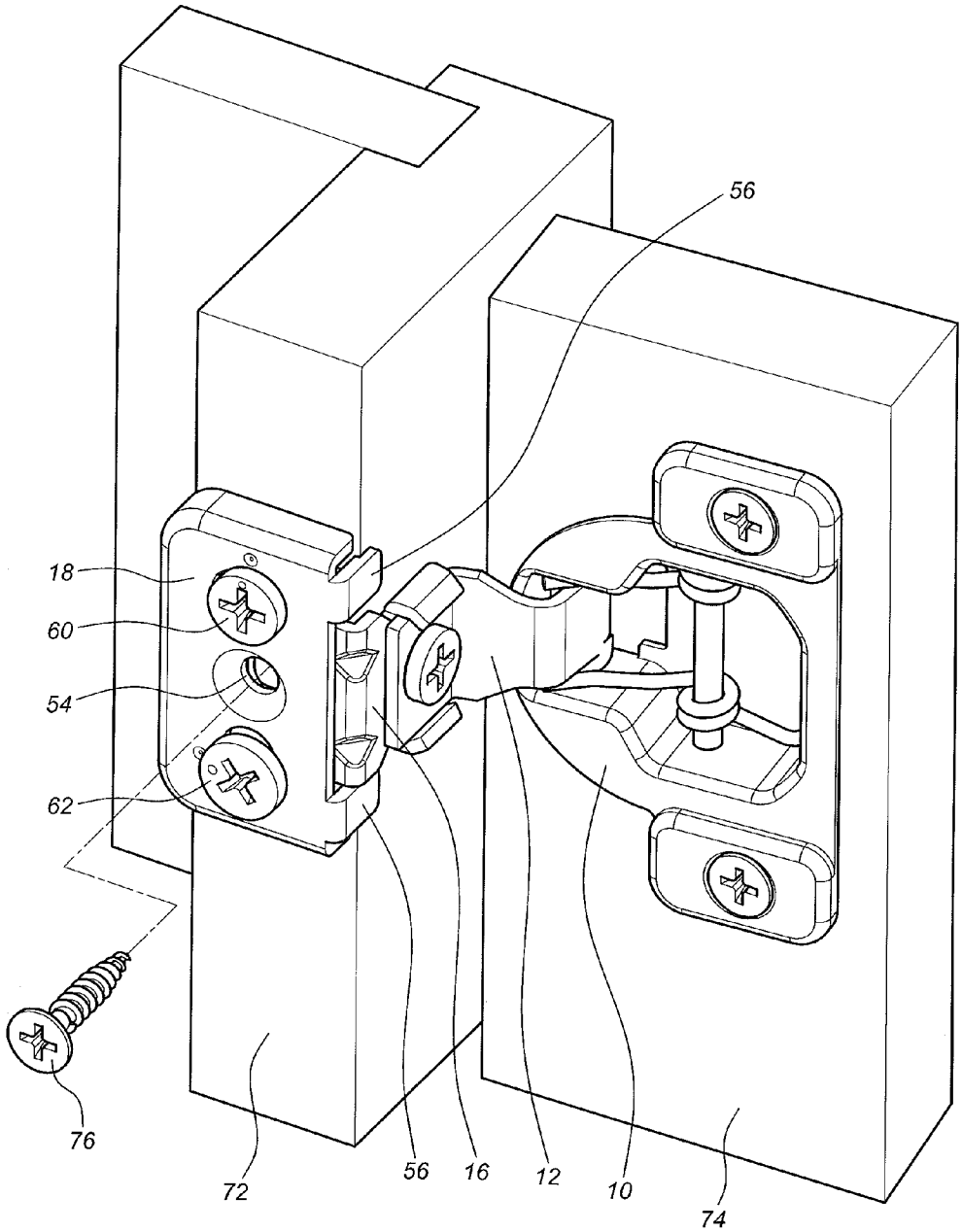
FIG. 6 is a perspective view illustrating mounting of the hinge of FIG. 1 to a cabinet.
Figure 7:
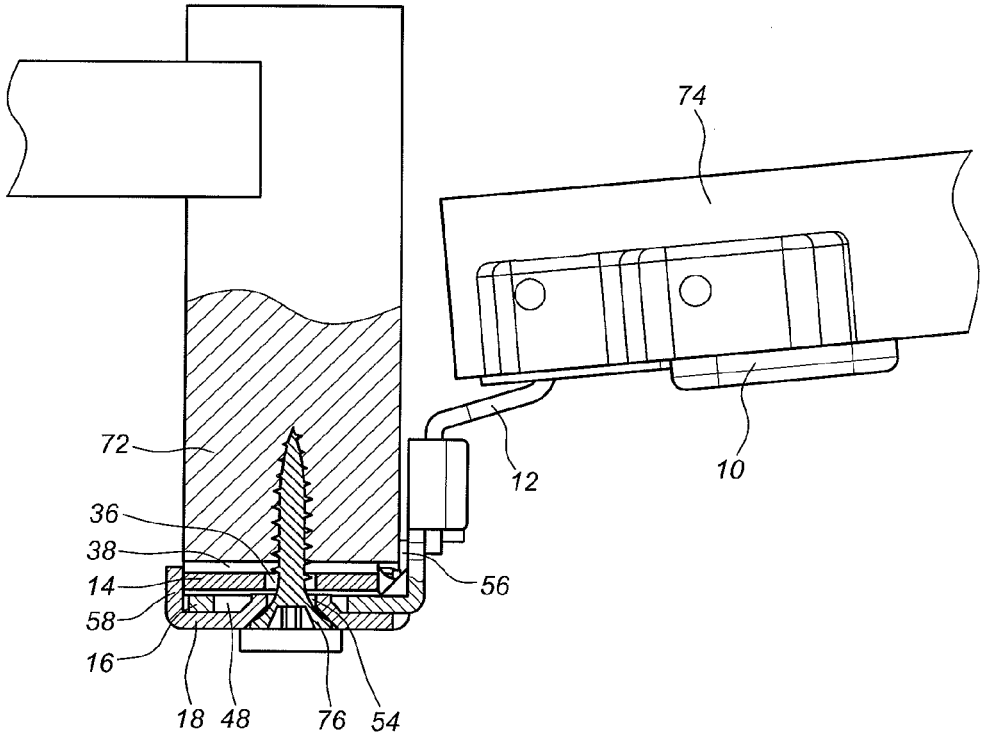
FIG. 7 shows a cross sectional view of the hinge and cabinet of FIG. 6.

With reference to FIGS. 6 and 7, when the hinge of the preferred embodiment is mounted to a cabinet body 72 and connected to a door 74, the ribs 38 of the bottom board 14 abut against an end face of the cabinet body 72. The legs 56 of the fixed seat 18 abut against a wall of the cabinet body 72. A fastener 76, such as a screw, is extended through the locking hole 54 of the fixed seat 18, the second through-hole 48 of the crank engagement seat 16, and the vertical elongated hole 36 of the bottom board 14 into the cabinet body 72. Thus, the fixed seat 18, the crank engagement seat 16, and the bottom board 14 are fixed to the cabinet body 72. The fastener 76 provides a tightening effect to securely clamp the crank engagement seat 16 and the bottom board 14 between the fixed seat 18 and the end face of the cabinet body 72, providing reliable positioning. The base 10 can be mounted to the door 74 in a conventional manner.

Figure 8:
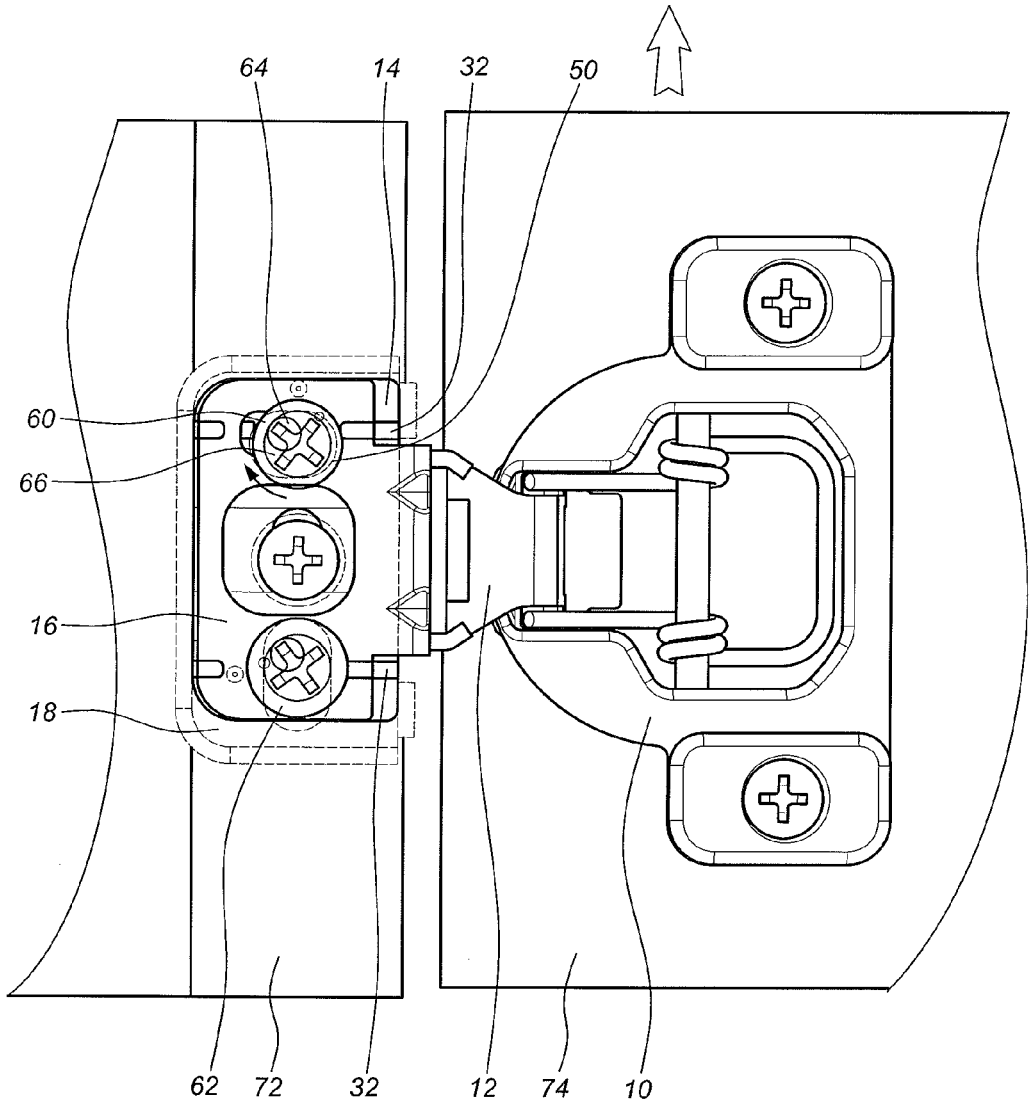
FIG. 8 is a schematic view illustrating adjustment of the hinge according to the present invention in a vertical direction.

With reference to FIG. 8, when the first cam 66 of the first adjusting member 60 is rotated in the first adjusting hole 50 of the fixed seat 18, eccentric rotation of the first rivet portion 64 of the first adjusting member 60 causes vertical movement such that the bottom board 14 is slightly moved by the first rivet portion 64 in the vertical direction. The crank engagement seat 16 is also moved vertically by the retaining portions 32 of the bottom board 14. Thus, the crank engagement seat 16, the crank 12, the base 10, and the door 74 can jointly move upwards or downwards relative to the cabinet body 72 in the vertical direction to adjust the vertical position.

Figure 9:
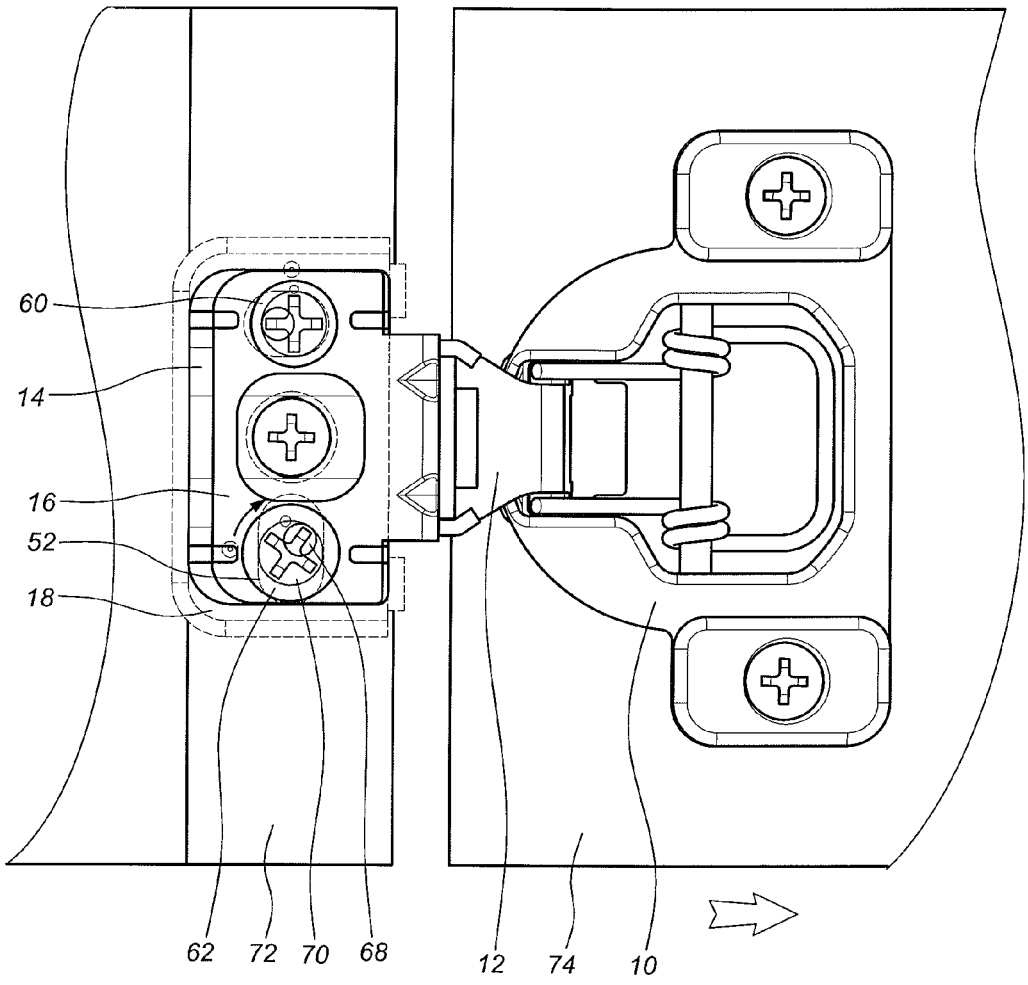
FIG. 9 is a schematic view illustrating adjustment of the hinge according to the present invention in a horizontal direction.

With reference to FIG. 9, when the second cam 70 of the second adjusting member 62 is rotated in the second adjusting hole 52 of the fixed seat 18, eccentric rotation of the second rivet portion 68 of the second adjusting member 62 causes horizontal movement such that the crank engagement seat 16 is slightly moved horizontally. Thus, the crank 12, the base 10, and the door 74 can jointly move leftwards or rightwards relative to the cabinet body 72 in the horizontal direction to adjust the horizontal position.

Figure 10:
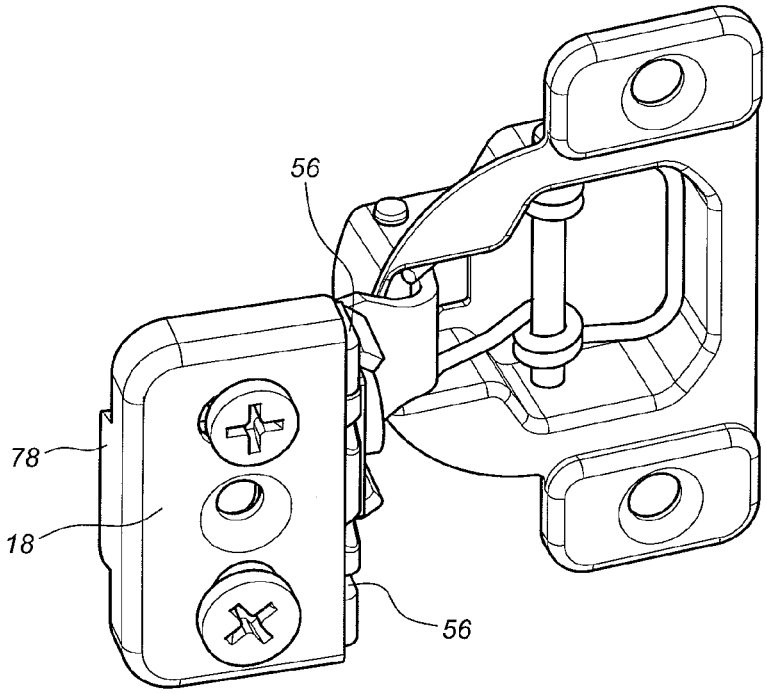
FIG. 10 shows a perspective view of a hinge of a modified embodiment having a tail.
Figure 11:
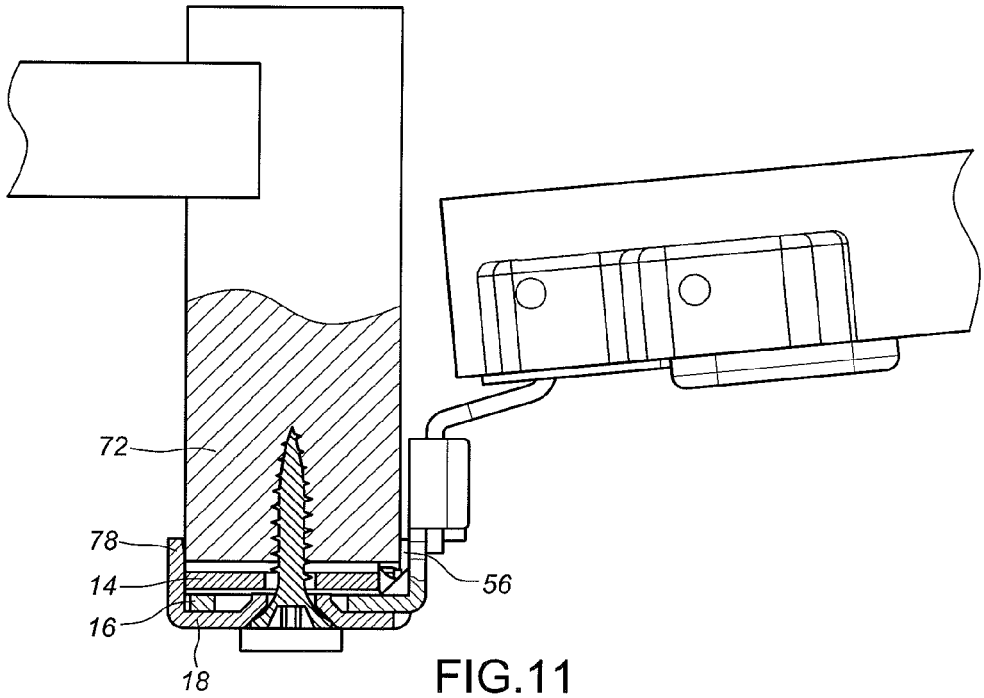
FIG. 11 is a perspective view illustrating mounting of the hinge of FIG. 10 to a cabinet.

FIGS. 10 and 11 shows another embodiment of the hinge according to the present invention, wherein a tail 78 extends from another side of the fixed seat 18 opposite to the side having the legs 56. A spacing between the tail 78 and the legs 56 is substantially equal to a thickness of the cabinet body 72. The tail 78 and the legs 56 abut two opposite walls of the cabinet body 72, such that the fixed seat 18, the crank engagement seat 16, and the bottom 14 can be more reliably mounted to the cabinet body 72.

Figure 12:
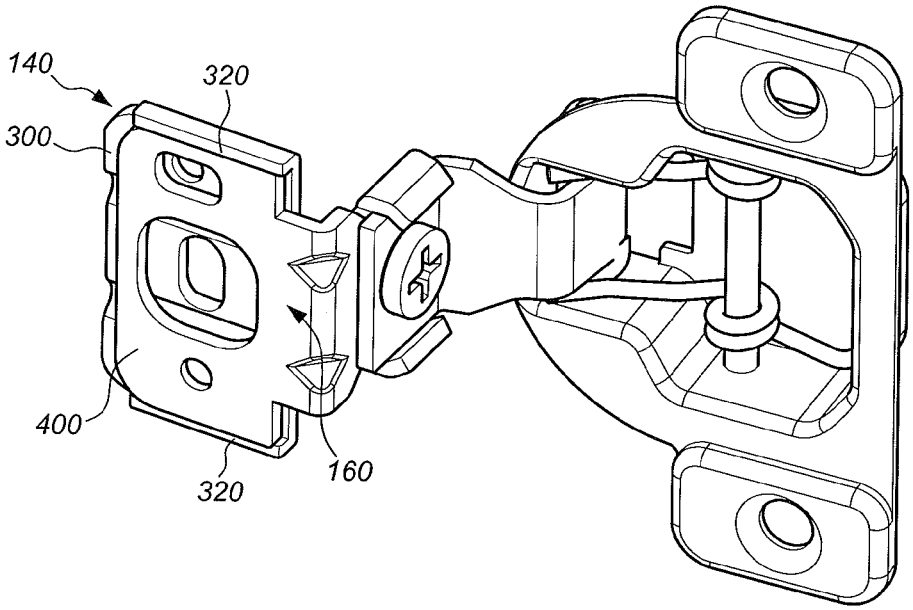
FIG. 12 shows a perspective view of a hinge of another embodiment according to the present invention.

To ensure the crank engagement seat 16 move relatively to the bottom 14 in the horizontal direction only, in another embodiment shown in FIG. 12, each retaining portion 320 is designed to extend from one face of a body 300 of a bottom board 140 to the other face of the body 300 of the bottom board 140. Thus, a first engaging board 400 of a crank engagement seat 160 is received in a space formed by the retaining portions 320.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A hinge comprising:

a base including a compartment;

a crank including opposite first and second ends, with the first end of the crank pivotably connected to the base;

an elastic element mounted in the compartment of the base and imparting elastic force to pivot the base relative to the crank to a position and to retain the base in the position;

a bottom board including a body and at least one retaining portion located on the body, with the body of the bottom board including a first rivet hole and a vertical elongated hole;

a crank engagement seat including a first engaging board and a second engaging board extended and bent from the first engaging board, with the first engaging board mounted on the bottom board, with the first engaging board interlocked with the at least one retaining portion of the bottom board so that the first engaging board is allowed to only move relatively to the bottom board in a horizontal direction, with the first engaging board including a first through-hole aligned with the first rivet hole of the bottom board, a second rivet hole, and a second through-hole located between the first through-hole and the second rivet hole, with the second through-hole aligned with the vertical elongated hole of the bottom board, with the first through-hole being a horizontal elongated hole, with the second engaging board connected to the second end of the crank;

a fixed seat including a first adjusting hole aligned with the first through-hole of the crank engagement seat, a second adjusting hole aligned with the second rivet hole of the crank engagement seat, and a locking hole located between the first and second adjusting holes, with the locking hole aligned with the second through-hole of the crank engagement seat, with the first adjusting hole being a horizontal elongated hole, with the second adjusting hole being a vertical elongated hole, with two spaced legs extending from a side of the fixing seat and located on two sides of the second engaging board of the crank engagement seat, with a peripheral wall extending from remaining sides of the fixed seat, defining a space for receiving the bottom board and the crank engagement seat; and an adjusting assembly including first and second adjusting members, with the first adjusting member including a first rivet portion and a first cam, with the first cam of the first adjusting member extended through the first adjusting hole of the fixed seat, with the first rivet portion extended through the first through-hole of the crank engagement seat and engaged in the first rivet hole of the bottom board, with the second adjusting member including a second rivet portion and a second cam, with the second cam of the second adjusting member extended through the second adjusting hole of the fixed seat, with the second rivet portion engaged in the second rivet hole of the crank engagement seat.

2. The hinge as claimed in claim 1, wherein the body of the bottom board includes a plurality of ribs.

3. The hinge as claimed in claim 1, wherein the at least one retaining portion of the bottom board extends in the horizontal direction by a predetermined length on the body.

4. The hinge as claimed in claim 3, wherein the first engaging board includes at least one connection portion corresponding to the at least one retaining portion of the bottom board, with the at least one connection portion and the at least one retaining portion being at least one pair of complementary protrusion and groove for mutual engagement.

5. The hinge as claimed in claim 1, wherein the at least one retaining portion extends from one face of the body of the bottom board to the other face of the body of the bottom board, so that the first engaging board is received in a space formed by the at least one retaining portion.

6. The hinge as claimed in claim 1, wherein the fixed seat includes another side opposite to the side having the two legs, with a tail extending from the other side of the fixed seat, with a spacing between the tail and the two legs substantially equal to a thickness of a cabinet body.

* * * * *